United States Patent [19]

Emunds et al.

[11] Patent Number: 4,998,040

[45] Date of Patent: Mar. 5, 1991

[54] PINCH SEAL MOUNT ASSEMBLY FOR ELECTRIC LAMP

[75] Inventors: Wilfried Emunds, Alsdorf-Ofden; Wilfried Krings, Wurselen, both of Fed. Rep. of Germany

[73] Assignee: U.S. Philips Corporation, New York, N.Y.

[21] Appl. No.: 478,293

[22] Filed: Feb. 7, 1990

[30] Foreign Application Priority Data

Feb. 10, 1989 [DE] Fed. Rep. of Germany ..... 3903892

[51] Int. Cl.[5] ..... H01J 5/48; H01K 1/36

[52] U.S. Cl. ..... 313/318; 313/49

[58] Field of Search ..... 313/318, 49

[56] References Cited

U.S. PATENT DOCUMENTS

| | | | |
|---|---|---|---|
| 3,262,001 | 7/1966 | Rijckeart | 313/318 |
| 4,485,326 | 11/1984 | Hellwig et al. | 313/318 |
| 4,567,397 | 1/1986 | Wilhelm et al. | 313/318 |
| 4,849,670 | 7/1989 | Hellwig et al. | 313/318 |

*Primary Examiner*—Donald J. Yusko
*Assistant Examiner*—John Edward Giust
*Attorney, Agent, or Firm*—Robert J. Kraus

[57] ABSTRACT

The electric lamp has a pinched seal (2) which is fixed in a lamp cap (5) with a metal shell (9) with cylindrically bent portions (10) by means of a retaining member (11). The retaining member (11) has a set of brackets (12, 13) between which the pinched seal (2) is clamped in. The clamping force (P) is generated in that the brackets (12, 13), after being inserted in the lamp cap (5), are moved away from one another through openings (14) in the lamp cap before being fixed to the shell (9) of the lamp cap (5).

4 Claims, 1 Drawing Sheet

PINCH SEAL MOUNT ASSEMBLY FOR ELECTRIC LAMP

FIELD OF THE INVENTION

The invention relates to an electric lamp provided with a lamp vessel with a pinched seal, which seal has two mutually opposing wider and two mutually opposing narrower surfaces; a lamp cap in which the pinched seal is fixed, which lamp cap has a metal shell with cylindrically bent portions near the narrower surfaces of the pinched seal; and a metal retaining member comprising a first and a second bracket, which brackets cooperate with respective wider surfaces of the pinched seal and which extend on either side of that pinched seal up to the shell of the lamp cap, along which shell they are bent and to which they are fixed.

BACKGROUND OF THE INVENTION

Such an electric lamp is known from U.S. Pat. No. 3,262,001. In the known lamp, the two brackets of the retaining member are fixed to each other by means of soldered or welded joints. The retaining member has thereby been coupled to the lamp vessel before it is inserted in the lamp cap. The brackets are bent alongside the shell of the lamp cap in mutually opposing directions.

A disadvantage of the known lamp is that only a narrow spread is allowable as to the thickness of the pinched seal of the lamp vessel, otherwise the retaining member will have no or no secure coupling with the lamp cap, or will cause excessive strain in the pinched seal.

Another disadvantage is that the retaining member, before it is inserted in the lamp cap, has to be compressed in order to assume dimensions which are smaller than the dimensions which it is to have at a later stage to effect all-round contact with the lamp cap. This involves the risk of the retaining member, when applied in the lamp cap, springing back to a degree which is insufficient for effecting fixing points to the lamp cap.

SUMMARY OF THE INVENTION

The invention has for its object to provide an electric lamp of the type described in the opening paragraph which has such a construction that it allows for, among other things, a wide tolerance as to the dimensions of the pinched seal.

This object, according to the invention, is achieved in that the shell of the lamp cap has near the narrower surfaces of the pinched seal a respective opening; the first and the second bracket of the retaining member extend substantially rectilinearly from the wider surface to the cylindrically bent portion of the shell and are bent along the said portion so as to face one another; and the said brackets extend at least up to the respective openings.

During lamp assembly, the two brackets of the retaining member with the pinched seal inserted between them are slid into the lamp cap as a non-bonded assembly without or substantially without prestress. Subsequently, flattened pegs are inserted through openings in the lamp cap between the first and the second bracket. These pegs are rotated, so that the first and the second bracket are pressed apart alongside the shell of the lamp cap. This builds up a tension in these brackets which causes the pinched seal to be clamped in. Since the tension in the brackets becomes greater in proportion as they are pushed further part, the clamping force on the pinched seal can be set as required. This results in a wide tolerance as to the thickness of the said pinched seal. The width of the pinched seal is practically immaterial.

It is favorable if the brackets on the one hand and the wider surfaces of the pinched seal on the other hand have cooperating reliefs. For example, the pinched seal has recesses while the bracket(s) has (have) corresponding protrusions, or vice versa. The pinched seal may also have protrusions which are accommodated in openings in the bracket(s). An advantage of this is that the pinched seal need be less strongly clamped in order to prevent shifting of the lamp vessel in the lamp cap.

The electric lamp may be an incandescent lamp or a discharge lamp, for example a halogen incandescent lamp. The shell of the lamp cap may only have portions which are cylindrically bent or it may be completely cylindrical. The retaining member may be fixed to the lamp cap, for example by soldering or welding, for example by means of a laser.

This and other aspects of the invention will now be described and explained in more detail with reference to the accompanying drawing.

DESCRIPTION OF THE PREFERRED(S)

Figure 1:
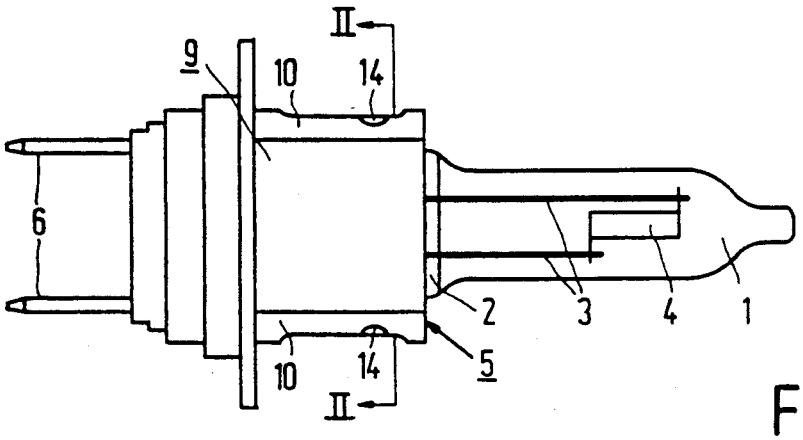
FIG. 1 shows an embodiment of a lamp according to the invention in side elevation.

In FIG. 1, the lamp has a lamp cap 1 with a pinched seal 2. Current supply conductors 3 extend from an incandescent body 4 through the lamp cap 5 to contacts 6 of the said lamp cap. The pinched seal 2 has two mutually opposing wider surfaces 7 and two mutually opposing narrower surfaces 8 (FIG. 2).

The lamp cap 5, in which the pinched seal 2 is fixed, has a metal shell 9 with cylindrically bent portions 10 near the narrower surfaces 8 of the pinched seal 2.

Inside the lamp cap 5 there is a metal retaining member 11 which comprises a first 12 and a second bracket 13, which brackets cooperate with respective wider surfaces 7 of the pinched seal 2. The brackets 12, 13 extend on either side of these wider surfaces 7 up to the shell 9. They are bent along the said shell and fixed to it.

Figure 2:
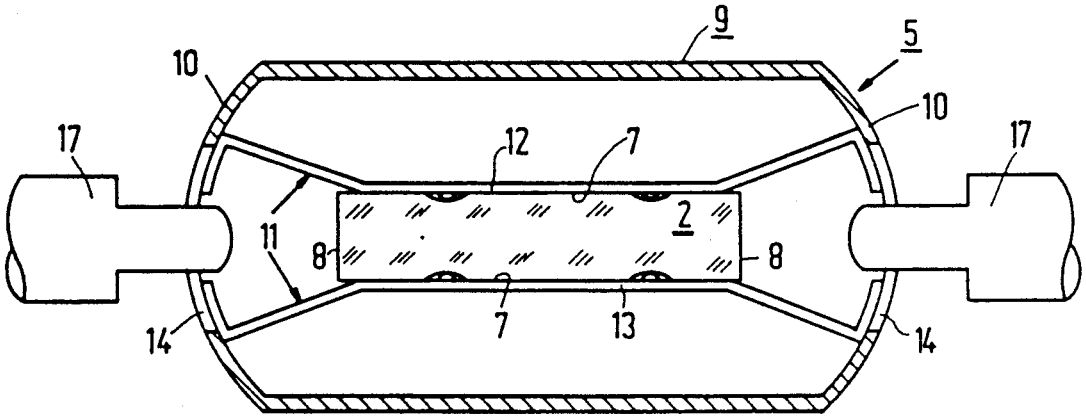
FIGS. 2 and 3 show the lamp of FIG. 1 in cross-section taken on II—II in two consecutive stages of its manufacture.
Figure 3:
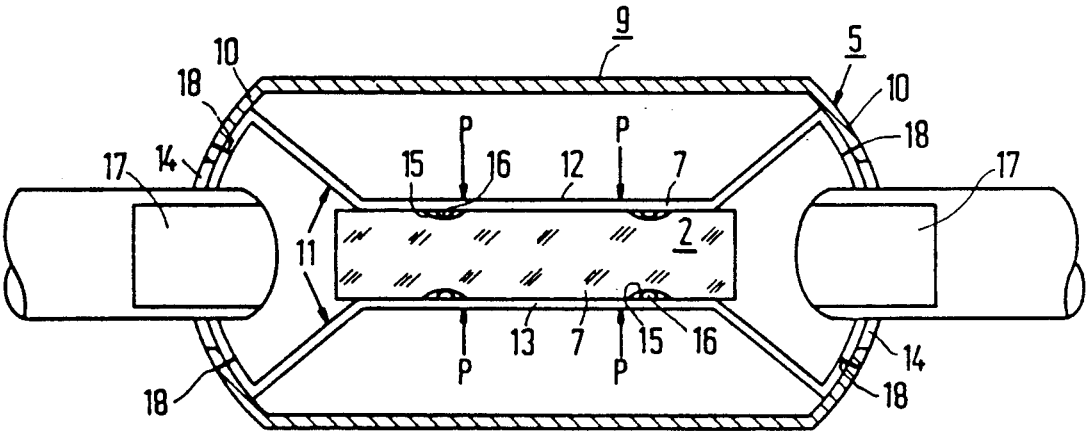

The shell 9 of the lamp cap 5 has openings 14 near the narrower surfaces 8 of the pinched seal 2 (see also FIGS. 2 and 3). The first 12 and the second bracket 13 extend substantially rectilinearly from the respective wider surface 7 to the relevant cylindrically bent portion 10 of the shell 9. They are bent along that portion so as to face one another and extend at least up to a respective opening 14 in the shell 9.

In FIG. 2, the retaining member 11 has been inserted in the lamp cap 5 with the pinched seal 2 in between. Recesses 15 in the wider surfaces 7 and protrusions 16 in the brackets 12, 13 prevent mutual shifting of the retaining member and the pinched seal. In FIG. 2 the retaining member 11 is without mechanical tension. Flat pegs 17 are inserted in the lamp cap 5 through the openings 14.

In FIG. 3, the pegs 17 have been rotated, so that the brackets 12 and 13 are pressed apart and exert a pressure P on the pinched seal. Subsequently, fixing points 18 are realised, for example laser welds, so that the brackets 12, 13 are secured to the cylindrically bent portion 10 of the shell 9.

The pegs 17 may then be rotated into their original positions and removed. The drawn embodiment shows a comparatively very thin pinched seal, so that the pegs have to be rotated far in order to build up a pressure P.

We claim:

1. An electric lamp provided with a lamp vessel (1) with a pinched seal (2), which seal has two mutually opposing wider (7) and two mutually opposing narrower surfaces (8); a lamp cap (5) in which the pinched seal (2) is fixed, which lamp cap has a metal shell (9) with cylindrically bent portions (10) near the narrower surfaces (8) of the pinched seal (2); and a metal retaining member (11) comprising a first (12) and a second bracket (13), which brackets cooperate with respective wider surfaces (7) of the pinched seal (2) and which extend on either side of that pinched seal up to the shell (9) of the lamp cap (5), along which shell they are bent and to which they are fixed, characterized in that the shell (9) of the lamp cap (5) has near the narrower surfaces (8) of the pinched seal (2) a respective opening (14); the first (12) and the second bracket (13) of the retaining member (11) extend substantially rectilinearly from the wider surface (7) to the cylindrically bent portion (10) of the shell (9) and are bent along the said portion so as to face one another; and the said brackets extend at least up to the respective openings (14).

2. An electric lamp as claimed in claim 1, characterized in that the brackets (12, 13) of the retaining member (11) and the wider surfaces (7) of the pinched seal (2) have cooperating reliefs (15, 16).

3. An electric lamp as claimed in claim 2, characterized in that the retaining member (11) is fixed to the shell (9) of the lamp cap (5) by means of laser welds (18).

4. An electric lamp as claimed in claim 1, characterized in that the retaining member (11) is fixed to the shell (9) of the lamp cap (5) by means of laser welds (18).

* * * * *